US006079806A

United States Patent [19]

Wen et al.

[11] Patent Number: 6,079,806

[45] Date of Patent: Jun. 27, 2000

[54] APPARATUS FOR PRODUCING HALFTONE IMAGES SUITABLE FOR LITHOGRAPHIC PRINTING PLATE

[75] Inventors: Xin Wen, Rochester; Seung H. Baek, Pittsford; Thap Dominh, Webster, all of N.Y.

[73] Assignee: Eastman Kodak Company, Rochester, N.Y.

[21] Appl. No.: 08/972,114

[22] Filed: Nov. 17, 1997

[51] Int. Cl.[7] ..... B41J 2/205

[52] U.S. Cl. ..... 347/10; 347/11; 347/15

[58] Field of Search ..... 347/10, 11, 14, 347/15

[56] References Cited

U.S. PATENT DOCUMENTS

| | | | |
|---|---|---|---|
| 4,412,226 | 10/1983 | Yoshida | 347/15 |
| 4,638,373 | 1/1987 | Logan | 347/15 |
| 4,833,486 | 5/1989 | Zerillo | 347/2 |
| 5,216,445 | 6/1993 | Hirasawa et al. | 347/15 |
| 5,501,150 | 3/1996 | Leenders et al. | 347/96 |
| 5,511,477 | 4/1996 | Adler et al. | 347/2 |
| 5,578,417 | 11/1996 | Noguchi et al. | 347/65 |
| 5,598,196 | 1/1997 | Braun | 347/68 |
| 5,599,648 | 2/1997 | Kondo et al. | 430/256 |
| 5,739,828 | 4/1998 | Moriyama et al. | 347/14 |

FOREIGN PATENT DOCUMENTS 0533168 3/1993 European Pat. Off. .

*Primary Examiner*—Richard Moses
*Assistant Examiner*—William A. Noe
*Attorney, Agent, or Firm*—Raymond L. Owens

[57] ABSTRACT

An ink jet printing apparatus responsive to an input digital image for producing a halftone image on a receiver, such as a lithographic plate, having halftone dots with each halftone dot being formed by one or more microdots in a screen dot of selectable areas, including an adjustable printhead for delivering different volumes of ink droplets which, when they contact the receiver, forming microdots of different areas according to the selected screen dot size. The apparatus delivers ink to the printhead and is responsive to a selected screen dot size and the digital image to control the printhead to form ink droplets of different volumes to produce a halftone image on the receiver.

9 Claims, 5 Drawing Sheets

60

| WAVEFORM SERIAL NUMBER (SNi) | INK DOT DIAMETER (Di) | PRINT DENSITY (Di) | 1st PULSE | | | 2nd PULSE | | | ------ |
|---|---|---|---|---|---|---|---|---|---|
| | | | $A_1$ | $W_1$ | $S_{1-2}$ | $A_2$ | $W_2$ | $S_{2-3}$ | |
| $SN_1$ | d1 | D1 | 1 | 1 | N/A | | | | |
| $SN_2$ | d2 | D2 | 1 | 1 | 1 | 1 | 0.8 | N/A | |
| $SN_3$ | d3 | D3 | ---------- | ---------- | ---------- | ---------- | ---------- | ---------- | ---------- |
| $SN_4$ | d4 | D4 | | | | | | | |
| ------ | ------ | ----- | | | | | | | |
| $SN_N$ | d max | Dmax | | | | | | | |

FIG. 2

APPARATUS FOR PRODUCING HALFTONE IMAGES SUITABLE FOR LITHOGRAPHIC PRINTING PLATE

CROSS REFERENCE TO RELATED APPLICATIONS

The present application is related to commonly-owned U.S. patent application Ser. No. 08/899,574 entitled "Digital Ink Jet Printing Apparatus and Method" filed Jul. 24, 1997, in the name of Xin Wen et al; and U.S. patent application Ser. No. 08/961,058 entitled "Apparatus for Printing Proof Image and Producing Lithographic Plate" filed Oct. 30, 1997, in the name of Xin Wen et al. The disclosure of these related applications is incorporated herein by reference.

FIELD OF THE INVENTION

The present invention generally relates to ink jet printing apparatus for producing halftone images on a receiver such as a lithographic plate.

BACKGROUND OF THE INVENTION

In the printing industry, graphical information such as photographs or artwork can be reproduced by one of several types of printing process. Lithographic printing is one such printing process. In lithographic printing, a lithographic plate is mounted on a lithographic press. The lithographic plate includes a hydrophilic surface on which an image pattern is created using hydrophobic material. A hydrophobic ink is used in printing. The ink is attracted to the hydrophobic image area on the plate and is repelled by the hydrophilic non-imaged area on the lithographic printing plate. The inked image is then used for making lithographic prints. The lithographic printing process is a complex process involving wet chemicals and costly equipment.

An ink jet printer produces images on a receiver medium by ejecting ink droplets onto the receiver medium in an imagewise fashion. The advantages of non-impact, low-noise, low energy use, and low-equipment cost in ink jet printing are not only responsible for the wide acceptance of ink jet printers homes and offices, but are also appealing to printing and publishing applications, especially in the context of digitally processed printing plates.

U.S. Pat. No. 4,833,486 disclosed an ink jet image transfer lithographic apparatus that transfers hydrophobic solid ink onto a lithographic plate in an image pattern according to the graphics and textual information. The plate can then be mounted in a lithographic press for lithographic printing. The printing image pattern can also be formed directly on the plate cylinder of the lithographic press.

In the printing industry, a digital halftone image typically comprises a plurality of screen dots as the basic image pixels with each screen dot providing gray scale in the image. The resolution of the screen dots, or the screen ruling, can change from 75 screen dots per inch to provide the lowest image quality to 300 screen dots per inch for the highest image quality. Each screen dot comprises a matrix of n×n micropixels with n typically being in the range of 1 to 12. Each of the micropixels can be occupied by a microdot. (see FIGS. 4 and 5).

Several requirements therefore exist for digitally reproducing a halftone image on a lithographic printing plate. The screen dot size (i.e. the screen ruling) needs to be adjusted to accommodate different printing resolutions as required by the printing jobs while the number of the micropixels within each screen dot may be kept the same. Furthermore, for a fixed screen ruling, the areas of the halftone dots need to be varied to simulate tone scale in an input image (i.e. area modulation). The size of the halftone dots can vary from one microdot to the full coverage of the screen dot (i.e. n×n microdots).

SUMMARY OF THE INVENTION

It is an object of the present invention to provide an ink jet printing apparatus that produces improved halftone images which are particularly suitable in lithographic printing applications.

These objectives are achieved by an ink jet printing apparatus responsive to an input digital image for producing a halftone image on a receiver, such as a lithographic plate, having halftone dots with each halftone dot being formed by one or more microdots in a screen dot of selectable areas, comprising:

a) an adjustable printhead for delivering different volumes of ink droplets which, when they contact the receiver, forming microdots of different areas according to the selected screen dot size;

b) means for delivering ink to the printhead; and c) means responsive to a selected screen dot size and the digital image to control the printhead to form ink droplets of different volumes to produce a halftone image on the receiver.

ADVANTAGES

The present invention provides improved halftone image patterns on receivers with ink dots of variable areas and is particularly suitable for lithographic printing in that it produces halftone image patterns on lithographic printing plates with variable screen dot resolutions.

A further advantage in accordance with the present invention is that the lithographic printing plate is directly produced by a drop-on-demand ink jet printer with low material and equipment cost without involving wet chemical processing.

BRIEF DESCRIPTION OF THE DRAWINGS

The invention will be better understood from the following description when taken in conjunction with the accompanying drawings wherein:

FIG. 2 shows an enlargement of the LUT of FIG. 1;

DETAILED DESCRIPTION OF THE INVENTION

The present invention is described with relation to an apparatus that is capable of producing both proof images and lithographic plates or other graphic arts media. By other graphic arts media those skilled in the art will understand that, flexographic printing plates, graphic arts photomasks, gravure printing cylinders and reusable offset lithographic printing cylinders are included.

Figure 1:
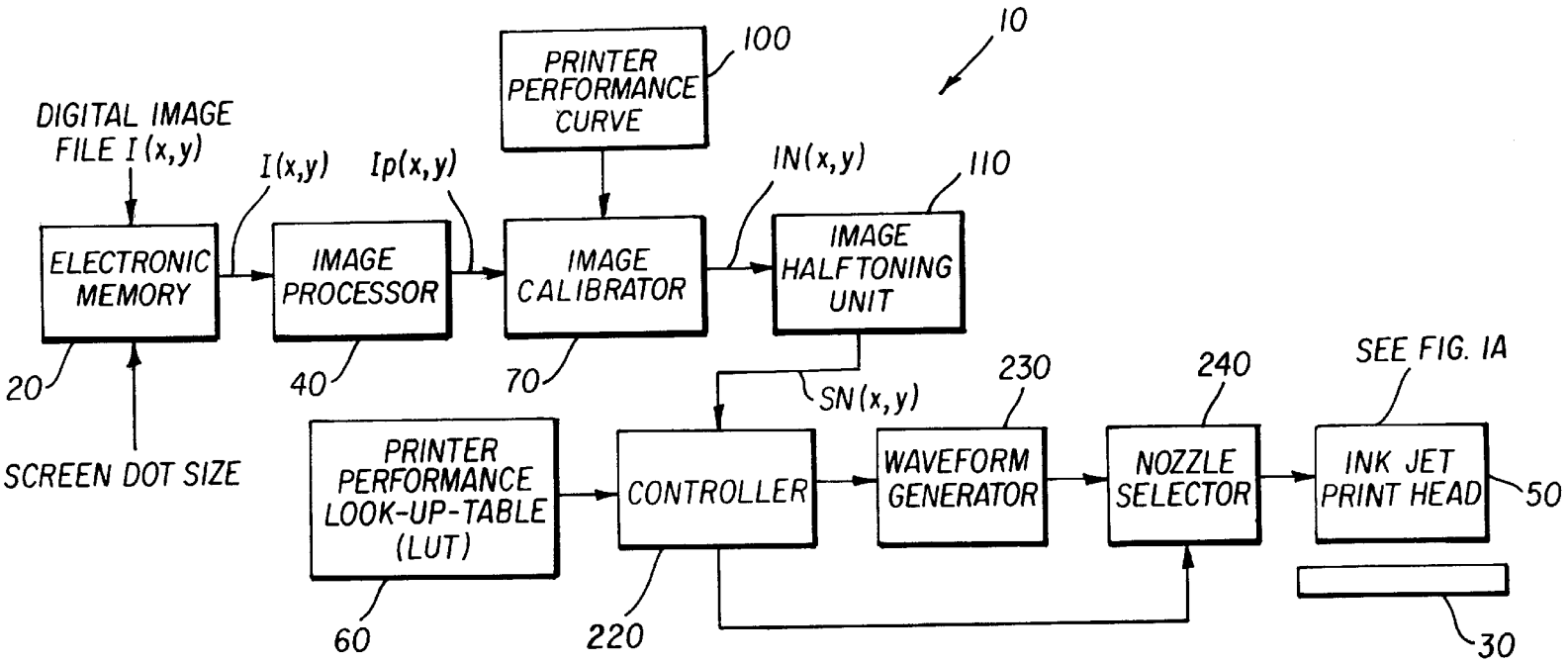
FIG. 1 shows a system block diagram in accordance to the present invention.

FIG. 1 illustrates an ink jet printing system 10 in accordance to the present invention. Details of various components in the ink jet printing system 10 are described in commonly-owned U.S. patent application Ser. No. 08/899,574 filed Jul. 24, 1997.

Referring to FIG. 1, the ink jet printing system 10 includes an electronic memory 20 that receives and stores an input digital image file I(x,y) for a printing job as well as the screen dot size (screen ruling resolution) for that printing job. With respect to image file I(x,y), the letters "x" and "y" designate column and row numbers, respectively, the combination of which define pixel locations in the image plane. More specifically, the pixel values at each "x" and "y" location correspond to the desired densities when printed on a receiver 30. In accordance with the present invention, the receiver 30 can be a lithographic printing plate, or a proof image receiver. The surface of the lithographic printing plate can include metallic surface, and metal laminates with paper and plastic. It is understood that the receiver 30 is also compatible with producing proof image patterns, and for image setting and screen printing applications, as disclosed in the above U.S. Patent Application. The image file I(x,y) may be generated by a computer or, alternatively, provided as an input generated from a magnetic disk, a compact disk, a memory card, a magnetic tape, a digital camera, a print scanner, a film scanner, or the like. Moreover, image file I(x,y) may be provided in any suitable format well known in the art, such as page-description language or bitmap format.

Next, still referring to FIG. 1, an image processor 40 that is connected to electronic memory 20 processes image file I(x,y). The image-processing operations can include decoding, decompression, rotation, coordinate transformation, mirror-image transformation, tone scale adjustment in addition to other desired operations (e.g. optionally, color management). The image processing operation also includes a step that resizes the input image file I(x,y) to match the the resolution of the screen ruling as required by input screen dot size. Image processor 40 generates an output image file Ip(x,y), which includes a plurality of pixel values having color code values corresponding to respective ink delivery nozzles 45 (only one of which is shown) in an ink jet print head 50, each nozzle 45 having an ink chamber 46 for ejecting an ink droplet 47 therefrom. The print heads can exist in different forms, for example, piezo-electric or thermal ink jet print head. An example of a piezoelectric ink jet print head is shown in commonly assigned U.S. Pat. No. 5,598,196.

The inks that are compatible with the ink jet printing system 10 can be hot melt or hydrophobic polymer solutions in suitable solvents, such as polyesters, polyimides, polyacetals, hetals, etc., light sensitive solutions of hydrophobic monomers, oligomers and polymers including photopolymers of both addition and condensation type. The inks may also comprise pigments and dyes. Other examples of useful inks are disclosed in the above referenced U.S. patent application Ser. No. 08/196,058, entitled "Apparatus for Printing Proof Image and Producing Lithographic Plate" filed Oct. 30, 1997, as well as U.S. Pat. Nos. 4,833,486, 5,501,150, 5,511,477, 5,599,648, and 5,578,417; and European Patent 533,168 A1.

Figure 3:
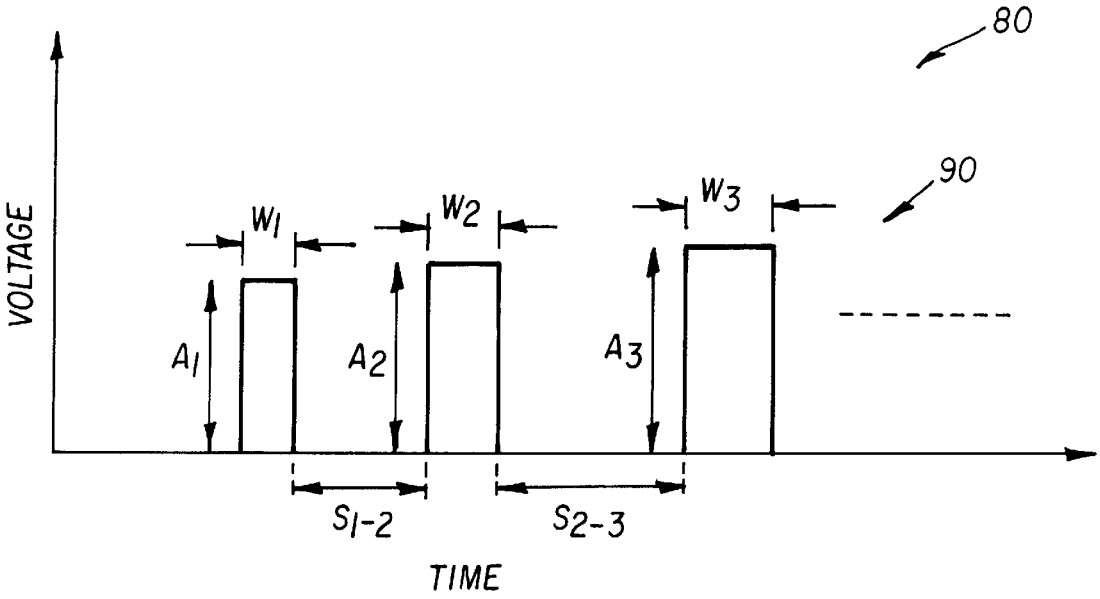
FIG. 3 is a graph illustrating an electronic waveform comprising a plurality or series of voltage pulses.

Referring to FIGS. 1, 2 and 3, data related to the performance of the ink jet printing system 10 are stored in printer performance look-up table (LUT) 60 and a printer performance curve 100. LUT 60 provides an electronic waveform, generally referred to as 80. An example of the many possible electronic waveforms is shown in FIG. 3 to include a group of "square" pulses, generally referred to as 90 (only three of which are shown), for driving the print head 50. Electronic waveform 80 is characterized by the number of square pulses, pulse widths (i.e., W1, W2, W3 . . . ), voltage pulse amplitudes (i.e., A1, A2, A3 . . . ), and delay time intervals (i.e., S1-2, S2-3 . . . ) between pulses 90. Predetermined values of pulse amplitudes, widths and delay time intervals between pulses are selected depending on a desired mode of operation of printhead 50. For example, a desired mode of operation for a piezoelectric ink jet print head 50 may be that frequencies of pulses 90 are reinforced by the resonance frequencies of an ink chamber 46, which is associated with each ink nozzle 45. Predetermining the values of the number of pulses, pulse amplitude, pulse width and time delay between pulses results in discrete ink droplet volumes that are modulatable by electronic waveform 80.

Referring to FIGS. 2 and 3, LUT 60 includes a plurality of ink spot diameters di (i=1, . . . , dmax) and associated optical density values Di (i=1, . . . , Dmax) corresponding to a plurality of electronic waveforms that are described by waveform serial numbers SNi (i=1, . . . , N). The ink spot diameters di (i=1, . . . , dmax) are tabulated as a monatomic function of waveform serial number SN for a predetermined electronic waveform 80 (e.g., square wave 90). The optical densities can be measured on a lithographic printing plate, a proof image, or a print produced by the lithographic printing plate. The optical densities can be reflective or transmittance densities measured using a densitometer in the Status "A" or Status "M" mode, respectively. The density Di is measured from a uniform density patch of a test image, which is printed by driving the nozzles with the waveform corresponding to the waveform serial numbers SNi. "N" is the total number of electronic waveforms in LUT 60 and "Dmax" is the maximum achievable optical density.

Returning to FIG. 1, image file Ip(x,y) is calibrated by image calibrator 70 to convert each pixel value to a waveform index number IN using (a) the target density at that pixel for that color and (b) printer performance curve 100. This calibration process results in an image file IN(x,y) with pixel values described by waveform index numbers IN.

Next, the calibrated image file IN(x,y) is input to image halftoning unit 110. Halftoning simulates a continuous-tone image using the limited optical densities printable by the ink jet printing system 10. The calibrated image file IN(x,y) comprises a plurality of pixels with each pixel described by waveform index number IN. As described hereinabove, the waveform index numbers IN are effectively continuous in nature, which are described by 8 or more bits per pixel (for each color separation). The total number of waveform serial numbers, N, corresponding to different halftone dot sizes and optical densities, is in the range 2 to 256, which is much smaller than the total number of waveform index numbers IN. The halftoning is accomplished by spatially modulating adjacent waveform serial numbers SNi (stored in LUT 60) each corresponding to a halftone dot size.

Figure 1A:
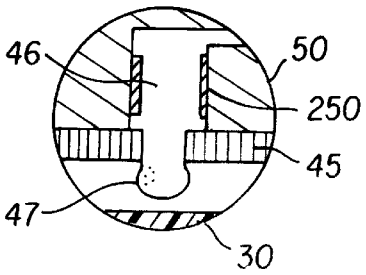

The halftoned image file SN(x,y) is next sent to a controller 220. Controller 220 performs the function of controlling the correct waveforms to be generated for corresponding pixels. Controller 220 accomplishes this function by (a) receiving a waveform serial number SN at each pixel and each color of the halftoned image file SN(x,y); (b) looking up the waveform parameters corresponding to the waveform serial number SN at that pixel and color of SN(x,y) using the printer performance LUT 60; (c) sending the waveform parameters to waveform generator 230; and (d) selecting the correct nozzle 45 corresponding to that color and the pixel by sending signals to a nozzle selector 240 that is connected to waveform generator 230. Waveform generator 230 generates correct waveforms in response to the waveform parameters provided by the controller 220 for providing the proper waveforms to actuate an electromechanical transducer 250 or a heat generating element 260 that in turn ejects droplet 47 from ink nozzles 45 in print head 50. That is, ink jet print head 50 may be a piezo-electric ink jet printhead as shown in FIG. 1*a*. Alternatively, ink jet printhead 50 may be a thermal ink jet printhead that ejects ink droplets by the thermal bubbles in the ink fluids. The waveform generator 230 can include an electric circuit (not shown) for producing the correct digital waveforms in combination with a digital-to-analog converter (not shown), and amplifiers (also not shown). Image-wise activation and ink ejection of ink droplets 47 reproduces the input digital image by a halftone image on the receiver 30.

The present can be better understood by the following examples.

EXAMPLE ONE

This example illustrates how ink jet printing system 10 generates microdots of different sizes to provide different screen dot resolutions (screen rulings) as required by the input screen dot size.

For a fixed micropixel configuration within a screen dot, for example, 12×12 micropixels in each screen dot, the size of the screen dot can vary from 75 to 240 lines per inch (lpi) depending on the printing applications. Correspondingly, the microdot size changes from 28 microns (75 lpi) to 8.8 microns (240 lpi). Although the image resolutions is varied (finer pixels at 240 lpi vs. larger pixels at 75 lpi), the number of gray levels (e.g. 144) is maintained to be the same in the halftone image.

Figure 4:
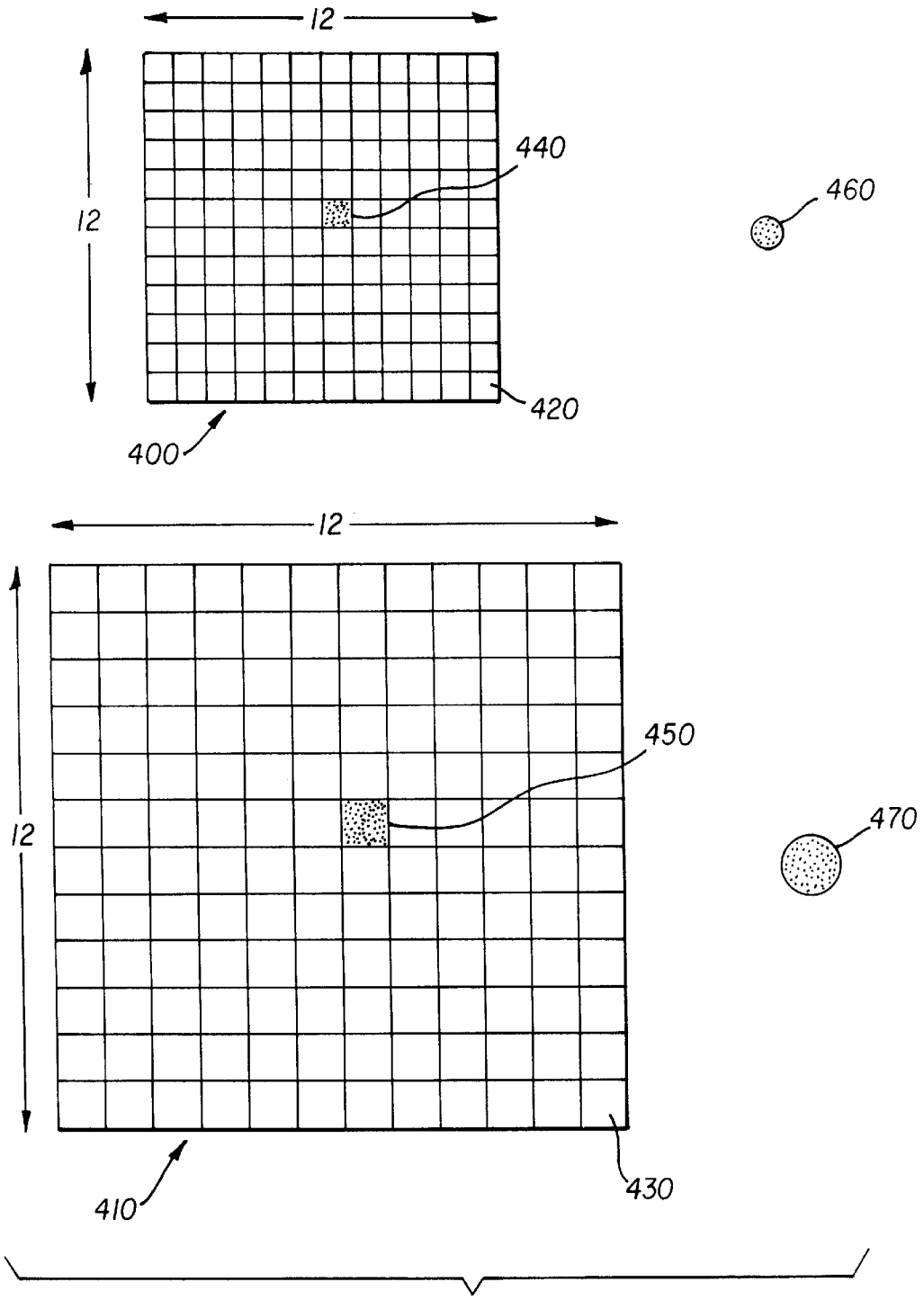
FIG. 4 illustrates an example of two screen dots of different sizes that can be used in accordance with of the present invention.

In FIG. 4, two screen dots 400 and 410 of different sizes are shown to have the same number (12×12) of micropixels. The. micropixels 420 and microdot 440 in the smaller screen dot 400 are proportionally smaller than the micropixel 430 and the microdot 450 in the larger screen dot 410. In accordance with the present invention, the ink jet printing system 10 is capable of producing ink spots 460 and 470 by ejecting ink droplets 47 of different volumes from the print head 50. The ink droplet volumes are varied by activating the print head 50 using different electronic waveforms 80. As a result, the diameters of the ink spots 460 and 470 can be adjusted to match the microdots 440 and 450 to be consistent with the input screen dot size (75–300 lpi). Halftone dots can be formed either by a plurality of these microdots, or by varying the spot diameter as described in following example.

EXAMPLE TWO

This example illustrates how the ink jet printing system 10 generates halftone dots for a fixed screen ruling.

Figure 5:
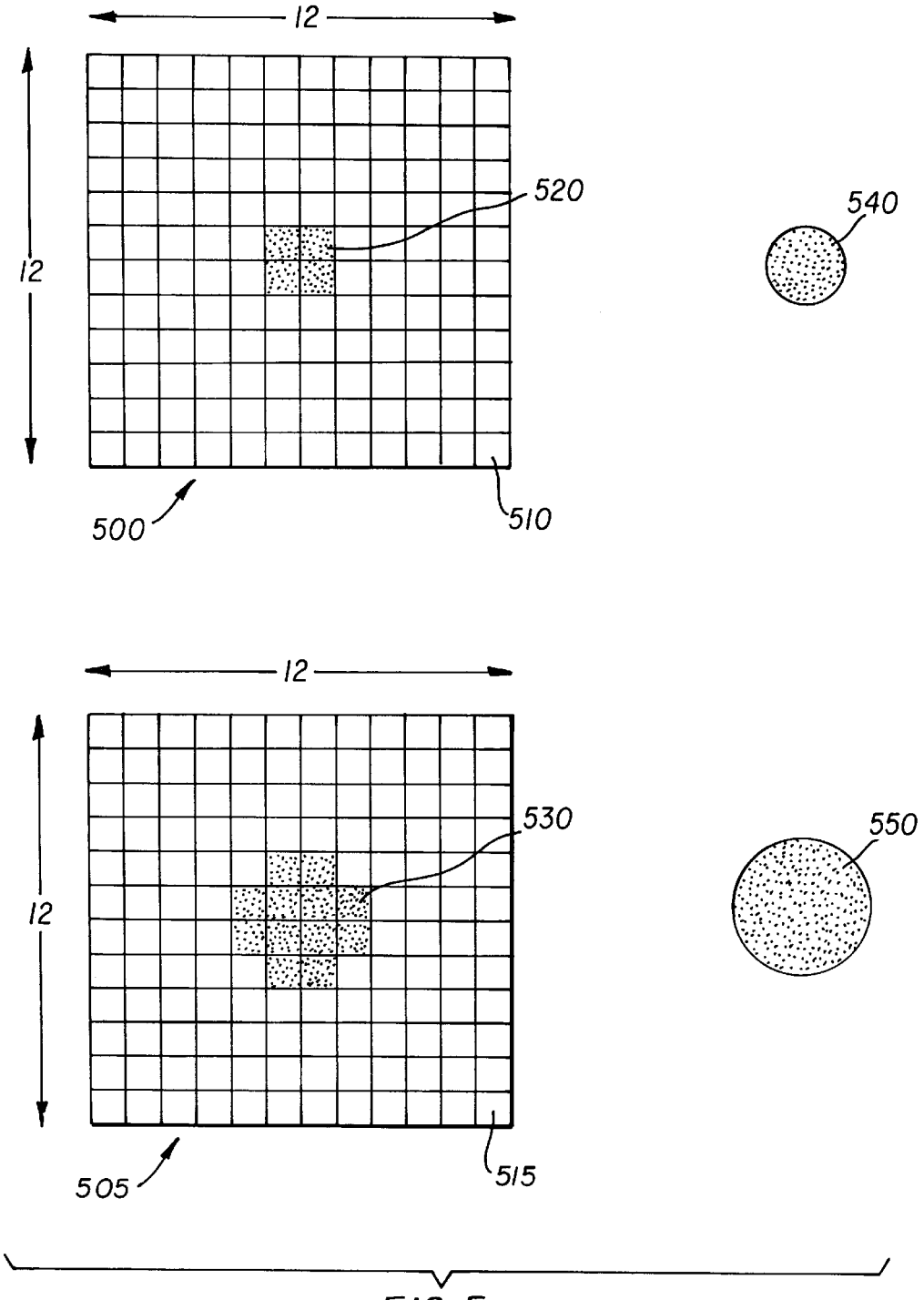
FIG. 5 illustrates another example of halftone dots of different areas each comprising a plurality of microdots that can be used in accordance with of the present invention.

A typical input screen dot size is in the range of 75, 120, 150, 175, 200, 240, 300 lines per inch (lpi). Each screen dot can be subdivided into matrix of 8×8, 10×10, 12×12 micropixels with each micropixel corresponding to the position of a microdot. In FIG. 5, a screen dot 500 and a screen dot 505 are shown to comprise a matrix of 12×12 micropixels 515. A halftone dot is formed by one or a group of microdots. Halftone printing achieves visual density variation by modulating the halftone dot areas. In FIG. 5, halftone dots 520 and 530 of different areas are shown to comprise 4 and 12 microdots respectively. The printed halftone dot size can be changed from one microdot to the full screen dot. Overall, 144 gray level can be resolved in the halftone printing mode in a matrix of 12×12 micropixels, corresponding to 0.69% to 100% of the maximum density.

The ink jet printing system 10 in accordance with the present invention produces halftone dots by placing ink spots of different sizes on the lithographic printing plate. In particular ink spots 540 and 550 are shown to produce the effects of the halftone dots 520 and 530 respectively. Ink spots 540 and 550 are formed by ink droplets 47 that are ejected from print head 50 by activating different electronic waveforms 80 SN'i as shown in FIGS. 1–3.

The invention has been described in detail with particular reference to certain preferred embodiments thereof, but it will be understood that variations and modifications can be effected within the spirit and scope of the invention.

What is claimed is:

1. An ink jet printing apparatus responsive to an input digital image for producing a halftone image on a receiver, such as a lithographic plate, having halftone dots with each halftone dot being formed by two or more microdots in a screen dot of selectable size, comprising:

a) an adjustable printhead for delivering different volumes of ink droplets which, when they contact the receiver, form microdots of different areas according to the selected screen dot size;

b) means for delivering ink to the printhead; and c) means responsive to a selected screen dot size and the digital image to control the printhead to form ink droplets of different volumes to produce screen dots each having a plurality of microdots to thereby form a halftone image on the receiver.

2. The ink jet printing apparatus of claim 1 wherein a single halftone dot of variable size is formed in the screen dot.

3. The ink jet printing apparatus of claim 1 wherein the means of element c) further includes means for determining the print density by controlling the diameter of the microdot.

4. The ink jet printing apparatus of claim 1 wherein the printhead is a piezoelectric inkjet printhead.

5. The ink jet printing apparatus of claim 1 wherein the printhead is a thermal inkjet printhead.

6. An ink jet printing apparatus responsive to an input digital image for producing a halftone image on a receiver, such as a lithographic plate, having halftone dots with each halftone dot being formed by two or more microdots in a screen dot of selectable size, comprising:

a) an adjustable printhead for delivering different volumes of ink droplets which, when they contact the receiver, form microdots of different areas according to the selected screen dot size;

b) means for delivering ink to the printhead; and c) means responsive to a selected screen dot size and the digital image to control the printhead to form ink droplets of different volumes to produce screen dots each having a plurality of microdots to thereby form a halftone image on the receiver, including:

i) a performance look-up table having information corresponding to electric signals which are useable by the printhead to control ink droplets of different volumes and ink dot diameter formed by each ink droplet; and ii) means coupled to the performance look-up table and responsive to the input digital image and the selected screen dot size for determining the pattern of microdots to be produced in the screen dots and having a waveform generator for producing the electrical signal for controlling the printhead to produce a desired volume of ink droplet.

7. The ink jet printing apparatus of claim 6 wherein a single halftone dot of variable area is formed in the screen dot.

8. The ink jet printing apparatus of claim 6 wherein the printhead is a piezoelectric inkjet printhead.

9. The ink jet printing apparatus of claim 6 wherein the printhead is a thermal inkjet printhead.

* * * * *